United States Patent [19]

Laapotti

[11] Patent Number: 4,551,205

[45] Date of Patent: Nov. 5, 1985

[54] PRESS SECTION WITHOUT PRESS SUCTION ROLLERS IN A PAPER MACHINE

[75] Inventor: Jorma Laapotti, Jyväskylä, Finland

[73] Assignee: Valmet Oy, Finland

[21] Appl. No.: 523,974

[22] Filed: Aug. 17, 1983

[30] Foreign Application Priority Data

Aug. 24, 1982 [FI] Finland ..... 822933

[51] Int. Cl.[4] ..... D21F 3/04; D21F 3/08

[52] U.S. Cl. ..... 162/360.1; 162/305; 162/306; 162/359

[58] Field of Search ..... 162/360, 359, 358, 305, 162/306, 205

[56] References Cited

U.S. PATENT DOCUMENTS

| | | | |
|---|---|---|---|
| 3,185,617 | 5/1965 | Justus | 162/360 |
| 4,056,433 | 11/1977 | Koponen | 162/305 |
| 4,163,688 | 8/1979 | Kankaanpaa | 162/359 |
| 4,192,711 | 3/1980 | Topio et al. | 162/359 |
| 4,209,361 | 6/1980 | Kankaanpaa | 162/305 |
| 4,257,844 | 3/1981 | Schmitt et al. | 162/305 |
| 4,440,598 | 4/1984 | Koski et al. | 162/305 |

*Primary Examiner*—William F. Smith
*Assistant Examiner*—K. M. Hastings
*Attorney, Agent, or Firm*—Steinberg & Raskin

[57] ABSTRACT

A press section of a paper machine has no suction rollers. The paper web is first conducted through a first two-fabric press nip supported by a first fabric which, in conjunction with a pick-up roller, serves as a pick-up fabric. The press section has press rollers in closed roller combination defining press nips with each other. A first two of the press rollers are provided with solid recessed surfaces. A third of the press rollers is a smooth-surface central roller of the press section. The second fabric serves as a press fabric at least in the first two-fabric press nip. The web is conducted through the first press nip defined by the first and second press rollers interposed between the first and second fabrics. The web is conducted through a second press nip supported by the first or second fabric. The second press nip is defined between the second press roller and the third press roller. The web is conducted between the first and second press nips, separate from the second press roller, over a return roller. Devices are provided in conjunction with the return roller to maintain the web in contact with the fabric supporting it on the sector of the return roller which is lapped by the first and second fabrics or the web supported thereby.

14 Claims, 5 Drawing Figures

W
11
12
10
P
24α
24
20
N1
N2
N3
21
22
31
32
33
30
40
41
42
43
43α
45
Sin
50
51
52
53
60
61
62
46
43'
47
Fo
33'
33"

PRESS SECTION WITHOUT PRESS SUCTION ROLLERS IN A PAPER MACHINE

BACKGROUND OF THE INVENTION

The present invention relates to a press section without press suction rollers in a paper machine.

In the press section, a paper web arriving from the wire section of the wire section of the paper machine is conducted, supported by a first topside fabric, at least through a first two-fabric nip. The first fabric also serves in connection with the pick-up roller as the pick-up fabric. The press section comprises, in closed roller combination, at least three, and preferably four, press rollers defining press nips together, two and two. The two of these press rollers which are first in the web's direction of travel are press rollers provided with a solid recessed surface. The third press roller is a smooth-surfaced central roller of the press section. The fourth roller, if any, is a recessed surface press roller. The press section further comprises a second fabric serving as a pressing fabric at least in the first two-fabric press nip. The web is conducted through the first press nip defined by the first and second press rollers interposed between the first and second fabrics and to the second nip and therethrough, carried by the first or second fabric. The second press nip is defined between the second press roller and the third smooth-surfaced press roller, and the third press nip, if any, is provided with a press fabric of its own.

The starting point of the invention was to develop further the same applicant's "Sym-Press" (Finnish Trademark) press section based on the service experience gained with the "Sym-Press" press over a period of several years.

The details of the "Sym-Press" press section are disclosed in Finnish publication document No. 50651 of the same applicant. The "Sym-Press" press section is a compact, so-called completely closed, press section wherein the paper web coming from the wire is conducted through a first nip defined by a recessed surface roller and a suction roller, interposed between two felts. The paper web is dewatered through both its surfaces. This press section comprises a smooth-surfaced central roller provided with at least one doctor means. A second nip is defined against this central roller, together with the aforementioned suction roller. Dewatering occurs in this nip through that surface of the paper web which faces the second roller of the first nip. In addition, at least one additional nip follows the second nip in this press section. The additional nip is defined between the smooth-surfaced central roller, which is larger in diameter than any other press roller in the press section, and a recessed surface roller, and a felt running through the additional nip. The additional nip is located substantially on the side of the central roller opposite the second nip.

The state of art associated with the invention is further disclosed in U.S. Pat. No. 4,257,844 and in the magazine articles, "Das Papier", Heft 1, pages 33–34, 1981, and "Norsk Skogindustri" No. 3, 1974, page 80.

The "Norsk Skogindustri" article describes a modification of the aforementioned "Sym-Press" press section, in which the "Sym-Press" suction roller does not define a nip with the smooth-surfaced central roller. In this press section, a first double-felted press nip is arranged in conjunction with, or preceding, this suction roller. Dewatering occurs in two directions. A recessed surface press roller is disposed in conjunction with the smooth-surfaced central roller, substantially replacing the "Sym-Press" suction roller. The recessed surface press roller defines the second press nip of the press section together with the smooth-surfaced central roller. A third press nip is defined substantially on the opposite side of the smooth-surfaced central roller with reference to the second nip.

In known press sections, a press suction roller must be used, thereby introducing considerable drawbacks, as hereinafter discussed.

The perforation of the press suction roller may leave a marking on the web which is detrimental to the appearance of the paper and may affect the surface characteristics of the paper. Press suction rollers are expensive. They require an individual drive motor and a control system. Furthermore, they are noisy. In particular, their drilling is a demanding task and involves high costs. The perforation reduces the strength of the shell, so that special metal alloys have to be used as the raw material of the rollers, and the thickness of the shell must be great, resulting in high costs.

Press suction rollers consume much air, due to the fact that not only the air passing through the web and the felt enters the suction system, but also the air which enters the suction zone in the holes in the suction roller's shell upon each revolution. In addition, the sealing water of the suction box of the roller causes much trouble.

A drawback of operating technology associated with suction rollers is that the suction rollers make considerable noise.

Although it is often necessary to arrange for deflection compensation in press suction rollers particularly, this is usually not possible, because the shell of the suction roller is perforated and/or because the interior volume of the roller is occupied by the suction box to such an extent that, as a result, deflection compensating means, known in themselves in the art, cannot be accommodated therein.

As hereinbefore stated, the press suction roller in particular is an extremely expensive component. At present price levels it may cost as much as FIM 3 million.

U.S. patent application No. 470,197, filed Feb. 28, 1983, discloses the state of art most closely related to the invention. This Finnish patent application was filed on Mar. 5, 1982 and discloses a press section with objects largely similar to those hereinbefore mentioned.

In the press section disclosed in U.S. patent application No. 470,197, it is considered novel that:

(a) the press section has no press suction rollers, since its first double-felted press nip is defined between two recessed surface rollers having solid shells, (b) after or before the first nip (FIG. 7) the run of one fabric, that is, the lower fabric, and simultaneously the travel of the web supported by this fabric, is turned downward prior to the second, single-felt nip under guidance, through a given sector, by a suction roller or a recessed surface press roller within the loop of the second fabric. The magnitude of the sector is in the range of about 30° to 160°, and (c) the web is so conducted through the nips, at least three in number, that that surface of the web which was the surface opposite the forming wire will in the second and third press nips lie against the smooth surface of the central roller of the press.

Finnish patent application No. 763434 of the same applicant discloses the state of art closely related to the invention. This Finnish patent application is equivalent to U.S. Pat. No. 4,192,711 and discloses a procedure for detaching the paper web at the wet end of a paper machine from the forming wire, for its conduction in so-called closed conduction to the press section and for performing a dewatering pressing operation. In the procedure of U.S. Pat. No. 4,192,711, the web is conducted to lap a grooved and/or perforated roller within the felt loop on a very wide sector. Steam treatment is provided, with the steam being directed at the web from outside. The web and the felt, if any, under it on the roller is heated by the steam and the web is supported from outside as its direction changes. Thereafter, the heated web is carried on the felt to the first press nip, where it is pressed between a recessed surface roller and a smooth-surface roller in order to dewater it.

SUMMARY OF THE INVENTION

The principal object of the invention is to provide a press section of a paper machine in which no press suction rollers at all are needed.

An object of the invention is to provide a press section of a paper machine which operates at reduced noise.

Another object of the invention is to provide a press section of a paper machine which eliminates the drawback of known apparatus of inability to accommodate deflection compensating means.

Still another object of the invention is to provide a press section for a paper machine wherein the web can be conducted to the press and therethrough reliably in closed conduction without risk of breaks.

Yet another object of the invention is to provide a press section for a paper machine which retains, as much as possible, the advantageous properties of the "Sym-Press" press section.

Another object of the invention is to provide a press section for a paper machine which is a further development of the press section disclosed in U.S. patent application No. 470,197.

Still another object of the invention is to provide a press section for a paper machine which utilizes in a new manner the design solutions disclosed in U.S. Pat. No. 4,192,711.

Yet another object of the invention is to provide a press section for a paper machine comprising at least three press nips through which the web is transported without open draws and wherein no suction roller loaded by a press nip is needed in the press section. In particular, in paper machines of great widths, when high press loads are used, the loading of suction rollers, as known in the art leaves considerable room for improvement.

Another object of the present invention is to provide a closed conduction press section of a paper machine having paper technological advantages of great importance, among the most important of which is the equalizing of the filler and fines distribution in the paper by selecting the dewatering directions in the press suitably in view of the principal dewatering direction of the next-preceding section of the paper machine.

Still another object of the invention is to provide a press section for a paper machine in which the mode of loading of the smooth-surfaced central roller of the press, generally a granite roller, may be made favorable. This is particularly important in machines of great width.

Yet another object of the invention is to provide a press section of a paper machine in which, even though a suction roller is used, such roller does not operate as a press suction roller loaded by the nip.

Another object of the invention is to provide a press section for a paper machine in which the paper web and the fabric supporting it can be brought under a correct angle to the second press nip. In some earlier "Sym-Press" (TM) press section versions without suction rollers, the entrance angle is unfavorable, with the consequence that it is impossible to load the second press nip with sufficiently high line pressure due to air blowing induced by the rollers and fabrics.

Still another object of the invention is to provide a press section for a paper machine in which water may be collected from the recessed surface press rollers in a more advantageous manner than previously.

In order to attain the foregoing objects and those which will become apparent hereinafter, the principal feature of the invention is that between the first and second press nips dewatering the web, the web is conducted, separated from the second press roller, over a return roller. Means are provided in conjunction with the return roller to maintain the web in contact with the fabric supporting it, on the sector of the return roller which is lapped by the first or second fabric and the web supported by it.

A press fabric is understood, in the present application, to be any felt-like product manufactured from artificial or natural fibres which is conventionally used in paper machines, especially in their press sections, either to boost the dewatering of the web or to transport the wet web from one treatment step to another.

The press section of the invention has several advantages important in practice, which are hereinafter considered in greater detail. The press section of the invention permits the paper web to be transported through at least three press nips without open conduction and without any press suction roller loaded by a nip. A loaded press suction roller has been proven to be unreliable in durability in broad paper machines and when using high press loads, unless expensive special constructions are used.

Furthermore, in accordance with the invention, the paper web and press fabric may be conveyed to the second nip at a right angle, preferably almost tangentially, and in a manner whereby the air blowing induced by the rollers and the fabrics exerts no detrimental influence.

Another advantage of the "inverted version" of the invention, shown in FIG. 3, is a more symmetrical structure of the paper manufactured than previously. This results from the dewatering direction in the second and third nips, and lower loading of the central roller than previously. In this embodiment, however, the problems of broke removal from conjunction with the central roller arise, but proposed solutions of such problems have been presented.

The loading situation of the central roller of the press of the invention may be made favorable because the directions of the second and third press nips are such that the pressing loads and the loading caused by the proper weight of the central roller largely cancel out.

BRIEF DESCRIPTION OF THE DRAWINGS

For a fuller understanding of the invention, reference is had to the following description, taken in connection with the accompanying drawings, in which.

DESCRIPTION OF PREFERRED EMBODIMENTS

Figures 1A, 1B, 1C:
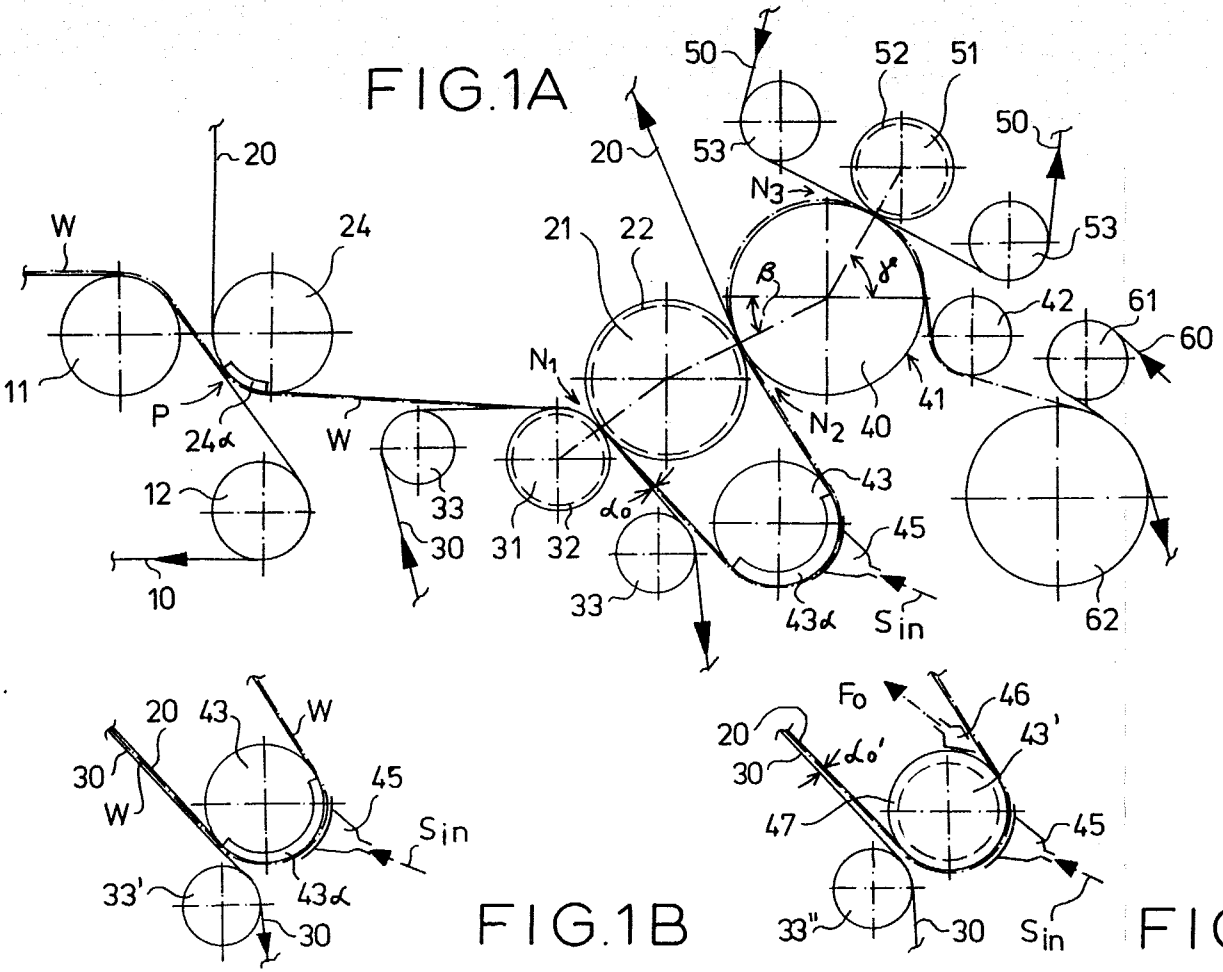
FIG. 1A is a schematic elevation diagram of a first embodiment of the press section of the invention.
FIG. 1B is a schematic elevational diagram of a second embodiment of the press section of the invention, showing the disposition of the return roller between the first and second nips.
FIG. 1C is a schematic elevational diagram of a third embodiment of the press section of the invention, showing the disposition of the return roller between the first and second nips.

The structural features common to the different embodiments of the invention, as shown in the FIGS., are first described. The paper web W is transferred to the suction sector 24α of the pick-up roller 24 at the detaching point P on the run between the rollers 11 and 12 of the fabric 10 of the wire section, onto the first felt 20 (FIGS. 1A, 1B, 1C and 2) and 120 (FIG. 3). Thereafter, the web W is made adherent to the underside of the first felt 20/120 with the assistance of the suction zone 24α and is thus transferred to the first press nip $N_1$ (FIG. 1A) and $N_1'$ (FIG. 3). The nip $N_1/N_1'$ is defined between the rollers 21 (FIGS. 1A and 2) and 121 (FIG. 3), and 31 (FIGS. 1A and 2) and 131 (FIG. 3). The pressing occurs in the first press nip $N_1/N_1'$ between the first felt 20/120 and the second felt 30 (FIGS. 1A, 1B, 1C and 2) and 130 (FIG. 3). The rollers of the nip $N_1/N_1'$ consist of two rollers 21 and 31/121 and 131 provided with recessed surfaces 22 and 32, respectively (FIG. 1A), and 122 and 132, respectively (FIG. 3), which are, for example, grooved rollers, blind-drilled rollers, or a grooved roller and a blind-drilled roller.

Subsequent to the first nip $N_1/N_1'$, the web is conducted, supported by the fabric 20 and 30/120 and 130, over the return roller 43 (FIGS. 1A, 1B and 2) and 143 (FIG. 3) by which the direction of the run of the web W is turned to become substantially opposite to the straight run after the first nip. More particularly, the web W is turned through approximately 180°, whereafter the web W is conducted to the second press nip $N_2$ (FIGS. 1A and 2) and $N_2'$ (FIG. 3), where the fabric 20/130 serves as a dewatering press fabric.

The second and third press nips $N_2$ and $N_3$ (FIGS. 1A and 2) and $N_2'$ and $N_3'$ (FIG. 3) are defined around the smooth-surfaced central roller 40 (FIGS. 1A and 2) and 140 (FIG. 3) of the compact press. The central roll 40/140 is preferably larger in diameter than the rest of the press rollers 21 and 51 (FIGS. 1A and 2) and 131 and 151 (FIG. 3) in its conjunction, so that adequate space is gained around the central roller for the nips and other apparatus. The central roller 40/140 is preferably a granite roller. The granite roller 40/140 has the advantage that adhesion of the web W pressed to the surface of said roller is greater than to the felt, and yet said web may be detached with ease from said surface by the effect of differential velocity when transferring said web from the press section to the drying section.

There are several usable alternative designs of return roller 43/143 within the scope of the invention. As shown in FIGS. 1A, 1B and 1C, the first nip $N_1$ is located at an angle of about 45° with the vertical plane, in which equivalent angle the joint run of the first fabric 20 and the web W is directed obliquely downward to the return roller 43. As shown in FIGS. 1A and 1B, the return roller 43 is a suction roller with an extensive suction zone 43α and may be rather light in structure, since there is no press nip in its conjunction. The suction sector 43α ensures that the web W remains on the fabric 20 when it turns on the return roller 43.

As shown in FIG. 1A, the directions of the fabrics 20 and 30 diverge after the nip $N_1$ at a small angle $\alpha_0$, and the tendency of the web W to follow specifically along with the fabric 20 is ensured by proper selection of the fabrics 20 and 30, so that they have the desired characteristics, and/or by means of the so-called felt cover after the nip $N_1$.

As shown in FIG. 1B, the guide roller 33' of the fabric 30 is so placed that said fabric escorts the web W up to the suction sector 43α, thus making sure that said web reliably follows the fabric 20.

As shown in FIG. 1C, the return roller 43' is provided with a recessed surface 47. As shown in FIG. 1C, after the nip $N_1$ the fabrics 20 and 30 separate at a small angle $\alpha_0$. Suction means 46 are provided in conjunction with the return roller 43' in the well between the fabric 20 and the trailing side of said roller. The suction means 46 extend over the entire length of the return roller 43' and create a vacuum in the aforementioned well and potentially also in the recessed surface 47 of said roller, thereby ensuring that the web W reliably follows the fabric 20.

As shown in the FIGS., a steam supply box 45 (FIGS. 1A, 1B, 1C and 2) and 145 (FIG. 3), known in itself in the art, is disposed in conjunction with the return roller 43/143 to act against the web W. The steam supply box 45/145 subjects the web W to steam treatment from the outside. This results in the web W being heated and, at the same time, supported from the outside, as it is changing direction. The object of the heat treatment is to promote the dewatering action in the next press nip, or press nips. These effects boosting the dewatering action are based both on the reduction of the viscosity of the water in the web W and on changes in the elastic properties of the fibre structure of said web, due to the increase in temperature. In this respect, U.S. Pat. No. 4,192,711, equivalent to Finnish patent application No. 763434, is again referred to.

As shown in FIGS. 1A, 1B and 1C, the return roller 43 is placed under the first press nip $N_1$. FIG. 3 shows an "inverted version" of the press section of the invention, in which the return roller 143 is positioned above the first press nip $N_1'$ and its rollers 121 and 131. The return roller 143 is provided with a suction sector 143α which operates, in the manner described, as a holding sector. Furthermore, the aforementioned steam supply box 145 is provided in the sector 143α. The steam supplied to the steam supply box 145 is indicated by an arrow $S_{in}$. The steam supply boxes 45/145 may be positioned elsewhere such as, for example, acting against the web W between the second and third nips.

As shown in FIG. 3, after the pick-up roller 24, the web and the first fabric 120 are directed upward at the angle α. The magnitude of the angle α is 10° to 80°, preferably about 30° to 60°. The first nip $N_1'$, defined between the recessed surface rollers 121 and 131, is a substantially vertical nip, and thereafter the web W follows the second fabric 130 on a substantially vertical run to the return roller 143, whereafter said web and said second fabric are conducted through the substantially vertical second nip $N_2'$. The second nip $N_2'$ is defined at the distance of an angle $\beta'$ with a horizontal plane passing through the center of the central roller 140. Similarly, the third nip $N_3'$ is defined in conjunction with the central roller 140 at an angular distance $\gamma'$ under the aforedescribed horizontal plane. In the third nip $N_3'$, the press roller 151 having a recessed surface 152 and provided with a press fabric 150 of its own, guided by the guide rollers 153, serves as the other press roller.

The embodiment of the invention shown in FIG. 3 is peculiar, since the top side of the web W, with reference to the forming wire 10, comes to abut the smooth-surface central roller 140. It is therefore possible to remove water in the nips $N_2'$ and $N_3'$ of the press section of FIG. 3 in such a direction that the asymmetry of the filler and/or fines distribution, resulting from stronger wash-out of said substances from the underside of the paper web, that is, from the surface abutting the forming wire 10, may be improved. Due to the influence of the dewatering direction in the nips $N_2'$ and $N_3'$, fines may be made in these nips to move along with the water being drained, towards the fabrics 130 and 150. The fabrics 130 and 150 retain the fines in the web and enrich them on the side of the web which abutted the forming wire 10.

The geometrical configuration of the press rollers shown in FIG. 1A is such that the central axes of the press rollers 31, 21, 40 and 51 are located substantially in one plane, which is preferably inclined at 30° to 60° upward with reference to a horizontal plane passing through the central axis of the press roller 31. Furthermore, as shown in FIG. 1A, the run of the first fabric 20 is substantially horizontal between the pick-up point P and the first nip $N_1$. The configuration of the press rollers results, for example, in the advantage that since the nips $N_1$, $N_2$ and $N_3$ are substantially opposite each other, the loads acting on the rollers due to the nip loading may be reduced.

As shown in FIG. 3, the press rollers 121, 131 and 140 are positioned with their central axes lying substantially in one plane. This results in a reduction of the stresses imposed on the rollers by the nip loads. Furthermore, the geometrical positioning of the rollers of FIGS. 1A and 3 provides a compact press section, although it affords sufficient space for various equipment, such as the press roller supporting and/or loading means, the guiding rollers, doctors and steam boxes, etc., of the different fabrics, taking into consideration potential trouble with various components in maintenance and operation.

A feature of the press section of the invention is that the suction rollers potentially used therein are without nip loading. The line pressures of the dewatering nips $N_1$, $N_2$, $N_3/N_1'$, $N_2'$, $N_3'$ are approximately 60 to 140 kN/m. Advantageously, the nip loading gradually increases as the web advances. An advantageous example of the nip loading in the press section of the invention, in a newsprint machine, is as follows. $N_1=60$ kN/m, $N_2=80$ kN/m, $N_3=110$ kN/m.

As hereinbefore mentioned, a stone central roller 40/140 of the invention results in favorable loading, since the nips $N_2$, $N_3/N_2'$, $N_3'$ are located substantially symmetrically, or at angles $\beta'$ and $\gamma'$, suitably selected in consideration of the nip loads, under the center of the central roller 140, and this results in the press rollers 132 and 151 taking up a major part of the weight of said central roller. Thus, for example, the proper weight of a stone roller 140 in a newsprint machine of great width is equivalent to vertical nip loading of up to about 80 kN/m.

Figure 2:
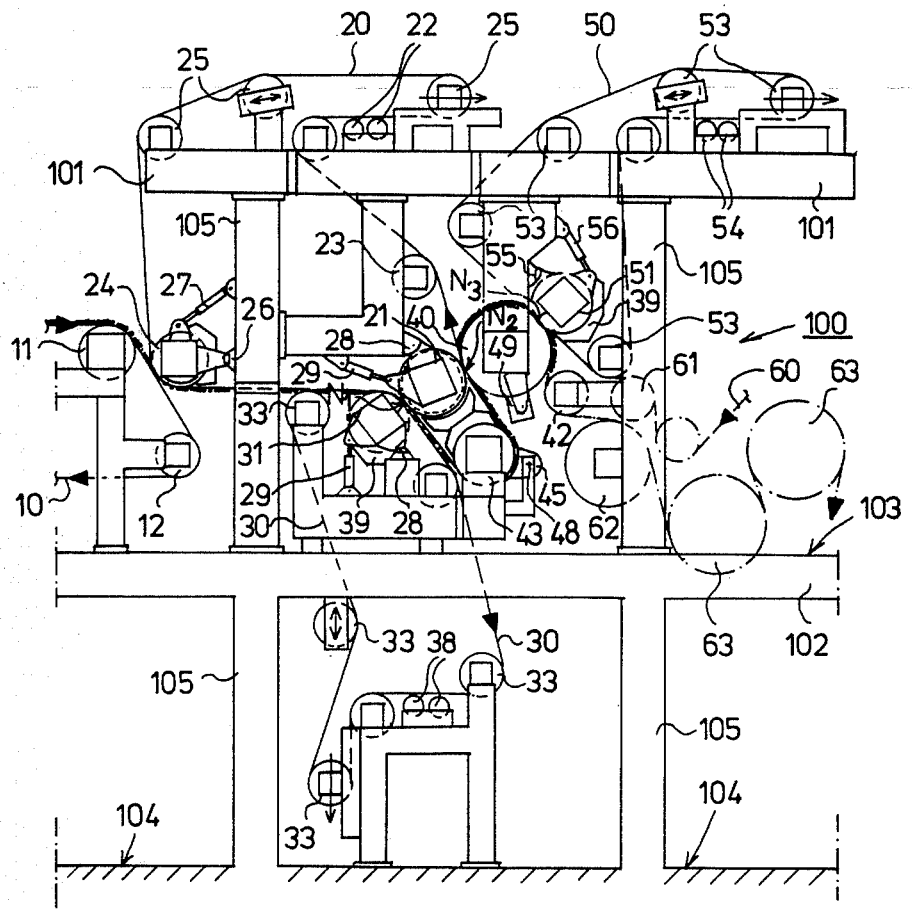
FIG. 2 is a schematic elevational diagram of the press section of FIG. 1A, with its frame structures and other ancillaries.
Figure 3:
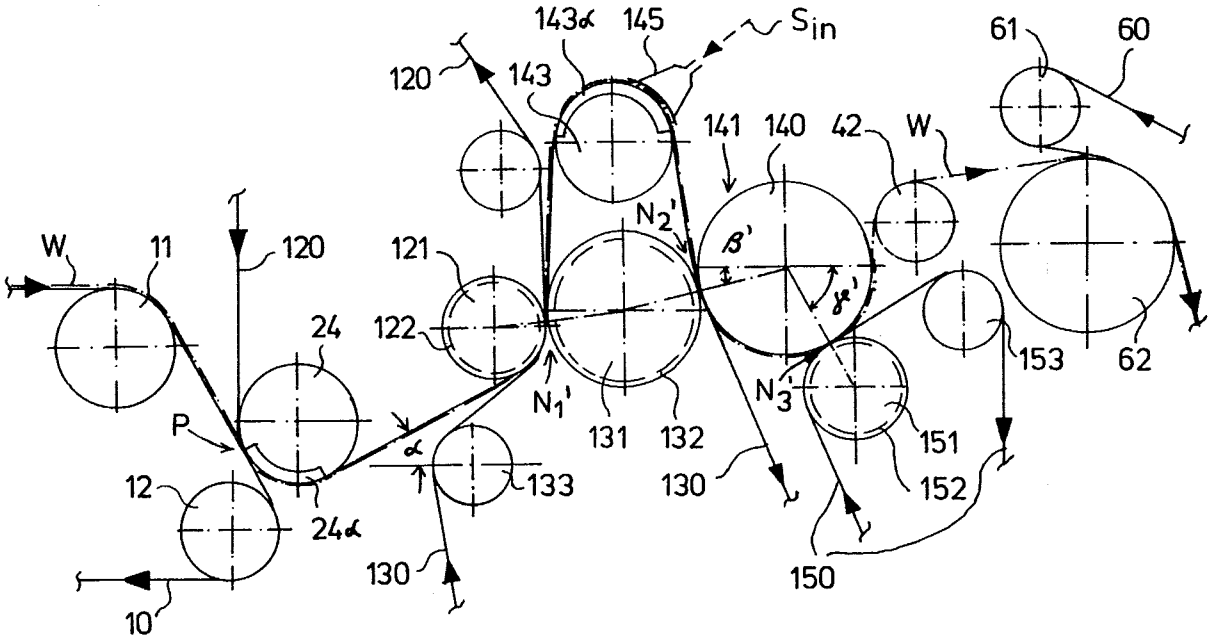
FIG. 3 is a schematic elevational diagram of an "inverted" embodiment of the press section of the invention, similarly as in FIG. 1A.

The roller geometry of FIG. 2 corresponds to that of FIG. 1A. Described hereinafter is an example of the frame structure and other components of the press section of FIG. 2 of the invention. The frame structure 100 of the press section of FIG. 2 consists of horizontal beams 101 and 102 on both sides of the press section and vertical beams 105 therebetween. In FIG. 2, the machine has a floor level 103 and the basement thereunder has a floor level 104. FIG. 2 shows the guide rollers 25 of the first fabric 20 and its conditioning means 22. The pick-up roller 24 is rotatably mounted on pivoted axles 26 and is turnable by action means 27 against the fabric 10. The press rollers 21 and 31 of the first nip $N_1$ are rotatably mounted in their respective frame parts, pivoted by pivot axles 28 to the frame 100 of the press section, and turnable by power means 29. The central roller 40 is rotatably mounted fixedly in the frame 100. The roller 51, defining the third nip $N_3$, is fixed in trunnions pivotally attached by pivot axles 55 and turnable by the action means 56. The action means 56 also provides the pressing load of the nip $N_3$.

The second fabric 30 and the fabric 50 of the third nip $N_3$ are conducted under guidance by the guide rollers 33 and 53, respectively, and conditioning means 38 and 54, respectively, are provided in conjunction with their runs.

The save-alls 39 of FIG. 2 are used in conjunction with the press rollers 21, 31, 51 and the return roller 43 to advantageously collect the water splashing from the surfaces of said rollers in order to prevent its reentry into the press fabrics.

As shown in FIG. 2, doctor means 49 is provided on the donwardly open sector of the central roller 40 for detaching paper going to broke from the surface of said central roller and directing same to broke collecting means thereunder (not shown in the FIGS.). In the embodiment of FIG. 3, special broke feeding means such as, for example, a screw conveyor (not shown in the FIGS.), are provided on the upwardly open sector of the central roller 140, for transporting the broke to one side of the press section.

After passing the central roller 40/140, the web W is conducted, guided by the guide roller 42, to the first drying cylinder 62. The fabric 60 guided by the guide rollers 61, is brought into contiguity with the first drying cylinder 62. The fabric guides the web W, in so-called single fabric conduction, to the drying cylinders 63, the first two of which are shown in FIG. 2.

The invention is by no means restricted to the aforementioned details which are described only as examples; they may vary within the framework of the invention, as defined in the following claims.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In a press section of a paper machine, said press section having a pick-up roller for conducting a paper web coming from a wire section to said press section, a first two-fabric press nip, and a first topside fabric supporting the paper web at least through said first two-fabric press nip and serving as a pick-up fabric in conjunction with said pick-up roller, and said press section having at least three press rollers in closed roll combination defining press nips with each other, a first two of said press rollers in the direction of travel of the web having solid recessed surfaces, a third one of said press rollers being a smooth-surface central roller of said press section, said first and second press rollers defining said first press nip, a second press nip defined by said second press roller and by said third press roller, a second fabric serving as a press fabric at least in said first press nip, the web being conducted to said second press nip through said first press nip interposed between said first and second fabrics and through said second nip while being supported by one of said first and second fabrics, the improvement comprising a return roller separate from said second press roller and located between said first and second press nips; and means in conjunction with said return roller for maintaining the web in contact with the fabric supporting the web on a sector of said return roller lapped by one of said first and second fabrics and the web thereby supported, wherein said press section having the closed roll combination defining the press nips is devoid of press nips formed with rollers of the suction type.

2. A press section as claimed in claim 1, additionally comprising a fourth press roller having a recessed surface, a third press nip defined by said third and fourth press rollers, and a third press fabric for said third press nip.

3. A press section as claimed in claim 1, wherein said first fabric supports the web, starting at a pick-up point and through both said first and second press nips, with the web being detached from said first fabric after said second press nip and adhering to the smooth surface of said third press roller.

4. A press section as claimed in claim 1, wherein said first fabric supports the web, starting at a pick-up point and through said first nip, with the web being transferred to said second fabric and being supported by said second fabric over said return roller to said second nip, and with the web being detached from said second fabric after said second press nip and adhering to the smooth surface of said third press roller.

5. A press section as claimed in claim 1, wherein said return roller comprises a suction roller having a suction zone extending substantially over the turning sector on said return roller of the web and of said one of said first and second fabrics supporting the web, said suction zone constituting said web contact maintaining means.

6. A press section as claimed in claim 1, wherein said return roller has a recessed surface and further comprising suction means situated in conjunction with said return roller, said suction means and recessed surface of said return roller constituting said web contact maintaining means.

7. A press section as claimed in claim 1, wherein said first fabric extends substantially horizontally between said pick-up roller and said first nip, and the axes of said first, second, and thrid press rollers are substantially coplanar in a plane inclined at about 30° to 60° with respect to a horizontal plane passing through the axis of said first press roller.

8. A press section as claimed in claim 1, wherein said first fabric after said pick-up roller extends obliquely upwardly at an angle having a magnitude of about 10° to 80°, and the axes of each of said first, second, and third press rollers are substantially coplanar in a substantially horizontal plane or a slightly upwardly-extending oblique plane, with the axis of said return roller being substantially above said plane.

9. A press section as claimed in claim 1, wherein said first and second fabrics separate by an angle after said first press nip.

10. A press section as claimed in claim 5, further comprising positive pressure means supporting the web on the turning sector of said return roller from the outside.

11. A press section as claimed in claim 5, further comprising a steam supply box at the turning sector of said return roller for supporting the web from the outside.

12. A press section as claimed in claim 5, further comprising a steam supply box at the turning sector of said return roller for supporting and heating the web to bolster dewatering in the following press nip.

13. A press section as claimed in claim 5, wherein said second fabric escorts the web to said suction zone of said return roller.

14. A press section as claimed in claim 8, wherein the magnitude of said angle is about 30° to 60°.

* * * * *